US006481883B1

(12) United States Patent
Ellen

(10) Patent No.: US 6,481,883 B1
(45) **Date of Patent: *Nov. 19, 2002**

(54) APPARATUS AND METHOD FOR MIXING CEMENTITIOUS MATERIALS HAVING A CYCLONIC DISC MIXER AND WEIGHING MEANS

(75) Inventor: Peter Edington Ellen, Wanchi (HK)

(73) Assignee: Pei Technology Inc. (HK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/381,949

(22) PCT Filed: Mar. 26, 1998

(86) PCT No.: PCT/AU98/00209

§ 371 (c)(1),
(2), (4) Date: Sep. 27, 1999

(87) PCT Pub. No.: WO98/43726

PCT Pub. Date: Oct. 8, 1998

(30) Foreign Application Priority Data

Mar. 27, 1997 (AU) ..... PO 5914
Mar. 27, 1997 (AU) ..... PO 5915

(51) Int. Cl.[7] ..... B28C 5/16; B28C 7/06

(52) U.S. Cl. ..... 366/65; 366/18; 366/37; 366/317

(58) Field of Search ..... 366/8, 18, 64–66, 366/96–98, 262–265, 270, 307, 315–317, 37; 416/228, 231 A

(56) References Cited

U.S. PATENT DOCUMENTS

| | | | | |
|---|---|---|---|---|
| 623,668 | A | * | 4/1899 | Holt, Jr. |
| 1,692,617 | A | * | 11/1928 | Bowen |
| 2,464,588 | A | * | 3/1949 | Knudsen et al. |
| 3,030,083 | A | * | 4/1962 | Stiffler |
| 3,044,750 | A | * | 7/1962 | Schmitt, Jr. |
| 3,147,958 | A | * | 9/1964 | Stiffler |
| 3,630,636 | A | * | 12/1971 | Hill |
| 3,638,917 | A | * | 2/1972 | Osten |
| 4,444,510 | A | * | 4/1984 | Janssen ..... 366/317 |
| 4,534,657 | A | | 8/1985 | Clement ..... 366/265 |
| 4,813,787 | A | * | 3/1989 | Conn ..... 366/316 |
| 4,834,542 | A | * | 5/1989 | Sherwood ..... 366/263 |
| 5,046,855 | A | * | 9/1991 | Allen et al. ..... 366/65 |
| 5,409,313 | A | | 4/1995 | Funk ..... 366/307 |
| 5,908,240 | A | * | 6/1999 | Hood ..... 366/65 |
| 6,042,259 | A | * | 3/2000 | Hines et al. |

FOREIGN PATENT DOCUMENTS

| | | |
|---|---|---|
| DE | 3 832 600 A1 | 3/1990 |
| DE | 195 04 033 A1 | 8/1996 |
| FR | 2 647 461 A1 | 11/1990 |

OTHER PUBLICATIONS

Derwent Abstract Accession No. 92–214956/26, SU, A, 1 680 291 (Far E Fleet Modernisation) Sep. 30, 1991.
Derwent Abstract Accession No. 88–263280/37, SU, A 1 378 905 (Kazan Chem Photo In) Mar. 7, 1988.

* cited by examiner

*Primary Examiner*—Charles E. Cooley
(74) *Attorney, Agent, or Firm*—Gifford, Krass, Groh, Sprinkle, Anderson & Citkowski, P.C.

(57) ABSTRACT

Apparatus for the rapid production of concrete having a grout slurry forming device, a cyclonic mixer for aggregate and a weighing device for feeding weighed amounts of aggregate to the cyclonic mixer. The slurry forming device including, subjecting fine particles in a liquid to the action of one or more rotating disc shaped blades, arranged to create within the slurry alternating areas of high and low pressures, thereby breaking up agglomerations. The cyclonic mixer includes, a hopper in which at least two conveyors simultaneously transport aggregate streams tangentially into, in opposite directions inducing helical mixing paths. The weighing device including, an aggregate weigher wherein a number of aggregate storage bins selectively releases aggregate onto a variable speed controlled conveyor. Intimately mixed concrete being formed from the simultaneous release of the grout slurry into the cyclonic mixer combining with the mixing aggregate.

7 Claims, 10 Drawing Sheets

APPARATUS AND METHOD FOR MIXING CEMENTITIOUS MATERIALS HAVING A CYCLONIC DISC MIXER AND WEIGHING MEANS

FIELD OF THE INVENTION

The present invention relates to apparatus and methods of producing concrete and to the component parts for such apparatus individually and in combination. More particularly it relates to apparatus and methods for mixing fine materials and water to form cementitious grouts and other such slurries: to apparatus and methods for cyclonically mixing aggregates and combining the aggregate mix with the grout to form concrete; and to aggregate weighing systems for delivery to such cyclonic aggregate blenders.

BACKGROUND ART

Modern concretes are required to be of a super performance standard and are composed of cementitious materials, water, chemical additives, fine and coarse aggregates mixed into a homogeneous mass which can be easily placed into a concrete structure. The cementitious materials and other fine materials included in concrete include such materials as, silica fume, pulverised fuel ash, and fine clay and mineral particles. These fine materials often agglomerate in clusters due to densification caused by packing (intentional or unintentional) and by the normal aggregation of fine particles.

These particles range in size from 0.02 micron to 1000 micron and aggregate into clusters having sizes of from 10 to 200 times the size of the individual particles. The clusters are caused to form, and are held together by, electrostatic or Van der Waals forces, mechanical adhesion, fusion etc. The aggregation of the particles prevents the intimate mixing of individual particles of different sizes together with the maximum packing density. This in turn is detrimental to the strength of the concrete structure formed from the concrete. The mixing of these materials varies from a simple stationary mixer to the specialised central mixing plants delivering mixed concrete to trucks for transportation to the construction site.

The mixer may be one of several types:

A) Dry Mixing: the most common process as there is no actual mixing plant, but the truck transportation bowl is designed as a mixing unit, while the concrete is being transported. This process is usually known as dry mixing as all the ingredients are loaded into the truck mixing bowl in a dry form together with the water and mixing takes place as the truck is transporting the materials to the site.

B) Central mixing: the equipment used usually consist of a specialised stationary mixing bowl and moving blades or paddles to rotate and mix the ingredients. The types and properties of concrete can vary widely and so do the types of equipment to mix the concrete.

As concrete mixtures have become more technical to achieve super properties the concrete ingredients and the mixing of those ingredients has become a highly specialised technology. The aim of the mixing process is to separate the individual cement particles and to surround these individual particles with individual particles of additives, such as silica fume. The cement and additive mixture should then surround the aggregate and fill the voids between individual pieces of aggregate. As the cement and additive particles are typically of very small dimensions considerable difficulty has been experienced in achieving the ideal mixing outcomes.

Conventional mixing processes are based on the philosophy of mixing the cements or cementitious materials with the aggregate and water to produce a consistent homogeneous mass of workable concrete. The mixing is achieved by the rotation of the blades or paddles moving the larger aggregates to inter-grind the cementitious materials.

The existing technology largely relies on mechanical mixing where the aggregates themselves can provide a part of the process of inter-grinding of the cementitious materials into the aggregates. The prior art mixing processes for the production of cementitious materials have the following disadvantages:

1. It is usually necessary to extend the grout mixing process over a long period of time to ensure that it is mixed due to material coagulation and lumps.
2. The machines described above are not capable of mixing stiff viscous materials.
3. Grout materials must be pumped some distance to be combined with the aggregates and there is usually considerable difficulty in emptying the discharge lines of the exact weighed materials originally present in the mixed proportions as there are no further materials to clear the lines, except by gravity flow which is very slow.
4. As the aggregates have been transported usually by conveyor into an aggregate holding bin these materials are usually segregated and on entering the mixing truck and together with the grouts require substantial mixing times (4 to 10 minutes).

An alternative process is to mix all the cementitious materials together with water and the chemical additives into a liquid grout which is then combined with the aggregates which, after mixing produces a homogeneous mass of workable concrete.

The present invention builds upon the alternative mixing process for concrete and addresses to problems outlined above in respect of forming the grout that is to be mixed with the aggregate from finely powdered materials. The invention provides an apparatus and a method for forming the liquid grout; apparatus and a method for cyclonically mixing aggregates to reduce segregation; to aggregate weighing systems; and to apparatus and a method combining the foregoing for mixing the liquid grout with the aggregate material to form concrete.

DISCLOSURE OF THE INVENTION

In a first aspect the present invention relates to a method of forming a slurry of particles of fine materials in a liquid, wherein the mixing and dividing of agglomerations of the particles of fine materials is carried out by subjecting a slurry of the agglomerations of particles to the action of one or more rotating discs shaped and arranged to create within the slurry alternating areas of high and low pressure, bubbles being formed in the low pressure zones and being compressed in the high pressure zones to implode with great force thereby breaking up the agglomerations of particles and at the same time separating and dispersing the individual particles of fine materials.

In a second aspect the present invention relates to an apparatus for forming a slurry of particles of fine material in a liquid, the apparatus including a housing adapted to receive and hold a slurry of particles of fine materials in a liquid which slurry contains agglomerations of the particles, and, located within the housing, one or more rotatable blades shaped and arranged to create within the slurry alternating areas of high and low pressure such that bubbles are formed in the low pressure zones and are compressed in the high pressure zones to implode with great force thereby breaking up the agglomerations of particles and at the same time separating and dispersing the individual particles of fine materials.

The method and apparatus according to the first and second aspects of the present invention could be used for the formation of slurries of any suitable fine material in any suitable liquid. The invention is however of particular applicability in the preparation of slurries of cementitious materials, such slurries being typically referred to as grouts. Such grouts may be mixed with aggregates to form concrete or may be used for other purposes.

In a third aspect the present invention relates to a method for the mixing of aggregate including conveying aggregate materials into a substantially conical hopper simultaneously along at least two conveyors disposed substantially tangentially to the hopper such that the aggregate is caused to enter the hopper along a substantially helical path with the aggregate from the said two conveyors travelling in opposite directions around the hopper.

In a fourth aspect the present invention relates to apparatus for the mixing of aggregate including a substantially conical hopper and at least two conveyors disposed substantially tangentially to the hopper, the conveyors being adapted to convey aggregate to the hopper such that the aggregate is caused to enter the hopper along a substantially helical path with the aggregate from the said two conveyors travelling in opposite directions around the hopper.

The method and apparatus according to the present invention may be used for mixing aggregate for a variety of purposes however they are of particular applicability in the mixing of aggregate of different sizes for inclusion in concrete.

In a fifth aspect the present invention relates to a method of mixing of grouts of a cementitious materials and the combining of the grouts with aggregate materials to be contained in concrete, the cementitious materials together with water and chemical additives being mixed in a grout forming apparatus according to the second aspect of the present invention, the aggregate being fed into an aggregate cyclone blender according to the fourth aspect of the present invention and thereafter the grout from the grout forming apparatus is delivered to the aggregate cyclone blender and mixed with the aggregate, the mixture being discharged from the aggregate cyclone blender into a secondary mixing apparatus.

In a sixth aspect the present invention relates to concrete producing apparatus for mixing grouts of cementitious materials and combining such grouts with aggregate materials to be contained in concrete, the apparatus including a grout forming apparatus according to the second aspect of the present invention disposed such that it can discharge into an aggregate cyclone blender according to the present invention.

In a seventh aspect the present invention relates to aggregate weighing means including a plurality of aggregate storage bins disposed above a conveyor, means to selectively release aggregate from one or more of the bins onto the conveyor, and means to vary the speed of the conveyor in accordance with the bin or bins from which the aggregate is being released.

BRIEF DESCRIPTION OF THE DRAWINGS

In order that the nature of the invention may be better understood a preferred form of the invention is illustrated by way of example in the accompanying drawings in which.

BEST METHOD OF CARRYING OUT THE INVENTION

The existing technology largely relies on mechanical mixing where the aggregates can be used as a method of inter-grinding of the cementitious materials into the aggregates. The prior art of mixing cement and water grouts and the processes are illustrated in FIGS. 1A–1D.

Figure 1A:
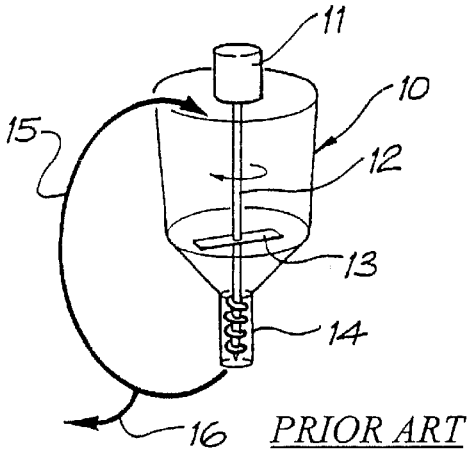
FIGS. 1A–1D are diagrammatic representations of various known apparatus for the forming of concrete from grouts and aggregates.

FIG. 1A illustrates a simple bowl 10 with electric motor 11 driving a vertical shaft 12 usually with a single impeller blade 13 turning a positive displacement pump 14 in the lower part of a conical or cylindrical bowl. The fluids and powders are blended with the impeller blade 13 and drawn down through the pump 14 and returned through recycle line 15 to recycle the materials into the upper part of the bowl 10. Allowing this cycle of mixing to proceed for 4 to 5 minutes will enable the cementitious materials to be mixed as grout.

The grout is discharged by the pump 14 through a discharge line 16 to supply the grout to either a concrete mixing process and/or a grouting process where it is typically used in the construction of pre-stressed concrete works and/or for ground soil stabilisation. These machines have a capacity to mix approximately 200 to 250 kg of cement in each batch operation (4 to 5 operations per hour) and are driven by a constant speed electric motor 11 of between 5 and 10 kW.

Figure 1B:
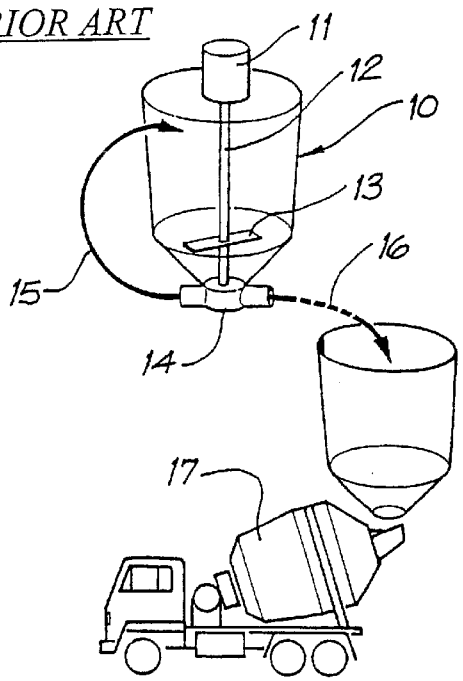

FIG. 1B illustrates a similar machine to that shown in FIG. 1A above, where the motor 11 is located on the top of the bowl 10 driving through a vertical shaft 12 to a centrifugal pump 14 either located in a horizontal or vertical position at the underside of the bowl 10. The piping is so arranged that the pump 14 normally recycles the grout materials back into the bowl 10 and when required for pumping purposes, is bypassed to discharge directly into some other plant or equipment for the purposes of mixing with the aggregates.

The adoption of a centrifugal pump for mixing purposes severely restricts the types of materials that can be mixed due to the thickening of the cementitious materials restricting the ability of a centrifugal pump to operate the limiting water cement ratio is usually in the range of 0.35–0.4. This restraint reduces the amount of cement or cementitious materials that can be mixed to approximately 50% of the total requirement. The balance must be added as dry cement and aggregates to the concrete mixing truck, as is done in the conventional "dry-mix plant" processes. Because of the necessity to provide ancillary equipment for weighing and measuring materials the mixed grout must be pumped from the grout mixing bowl 10 to the concrete mixing truck 17.

Figure 1C:
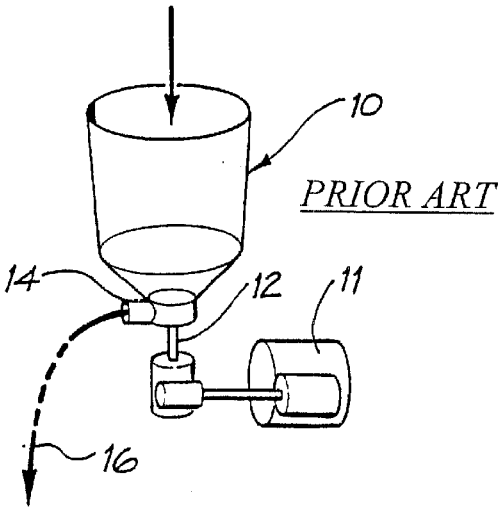

FIG. 1C illustrates a further version, similar to FIG. 1B, except that the power for the centrifugal pump 14 is provided from underneath the unit by 10 to 20 kW electric motor 11.

Figure 1D:
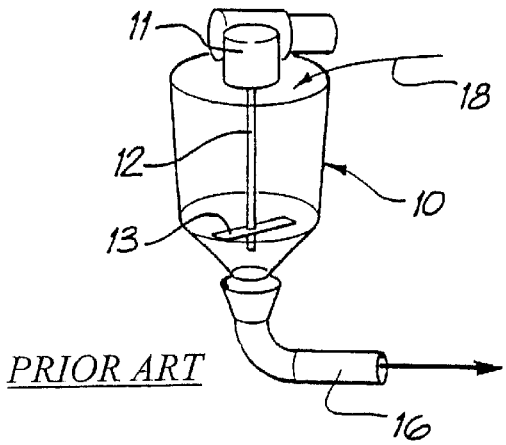
Figure 2:
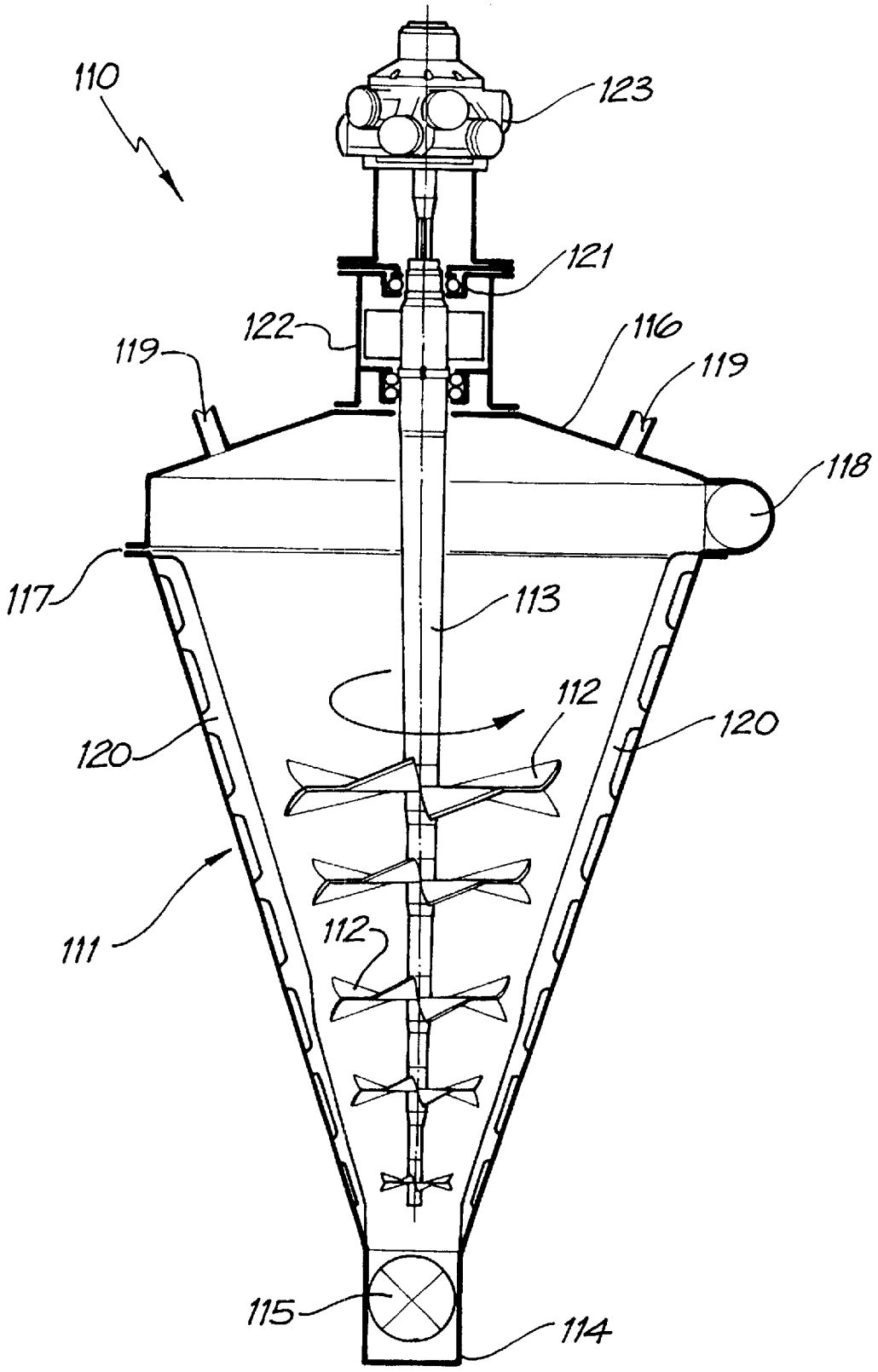
FIG. 2 is a cross-sectional view of a grout mixing apparatus according to the second aspect of the present invention.

FIG. 1D shows yet another known apparatus designed to avoid some of the difficulties and maintenance associated with the centrifugal pumps. In this arrangement a separate electric motor 11 of 15 to 20 kW capacity is mounted on a vertical shaft 12 driving mixing blades 13 within the bowl 10. As there is no pumping system, the unit relies on compressed air being introduced through air inlet line 18 to the bowl 10 to force the grout along a discharge line 16 to the central mixer and/or concrete mixing truck. Such a device requires a pressure tank system (not shown) and associated valves on all inlet and outlet pipes.

The concrete forming machine according to the present invention in a preferred form is composed of three separate parts. There is firstly the slurry forming apparatus in the form of a grout mixing machine 110 which is designed to thoroughly mix all the cementitious materials with water and chemical additives. There is secondly a cyclonic aggregate blender 130 designed to accept aggregates in two opposed streams from a pair of tangentially placed conveyors 131. There is thirdly an aggregate weighing system 132 which delivers weighed quantities of aggregate onto the conveyors 131 to be mixed in the a cyclonic aggregate blender 130.

The grout mixing machine 110, forming one element of the present invention, consists of a mixing bowl 111 and one or more mixing discs 112 attached to a rotating shaft 113. The grout mixing machine 110 is designed to use high pressure shock waves created when miniature bubbles of gas or air are caused to implode, to separate and/or cavitate fine powders such as Portland cement powders and additives such as silica fume, fine clay and mineral particles with water against a pressure plate.

The mixing bowl 111 of the grout mixing machine 110 is substantially conical, tapering downwardly, with an aperture 114 at the apex in which is disposed a control valve 115. An array of helical vortex control blades 120 are provided on the inside surface of the mixing bowl 111. These blades 120 are designed to limit the formation of a vortex within the mixing bowl 111. An upwardly dished cap 116 is disposed on the housing 111. The cap 116 is bolted around its periphery to the housing 111 with a gasket seal 117 therebetween. A water inlet 118 is provided tangentially into the radially outer edge of the cap 116 and a number of powder inlet ports 119 are provided in spaced apart array around the cap to allow the introduction of powders into the housing 111 in a manner that will allow even loading around the shaft 113. Air is exhausted through the water inlet 118 as powders are introduced into the housing 111 to control pollution due to dust emissions.

The shaft 113 is mounted in a pair of bearings 121 disposed centrally of the cap 116 and mounted in a tubular extension 122 of the cap 116. A variable speed hydraulic motor 123 is mounted on the extension 122 and connected to the shaft 113.

Figure 3:
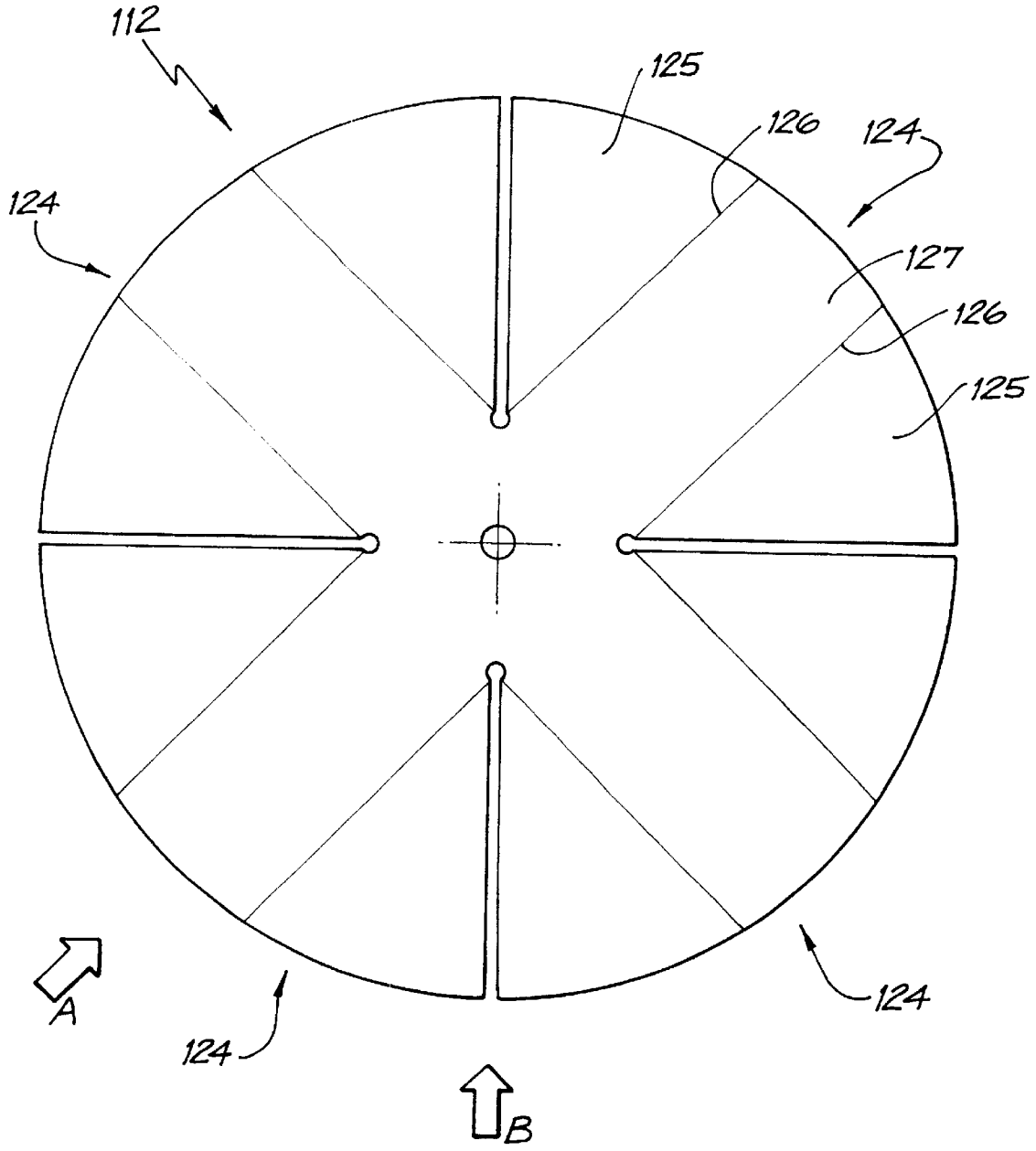
FIG. 3 is a plan view of a mixing blade comprising a part of the apparatus of FIG. 2.
Figure 4A:
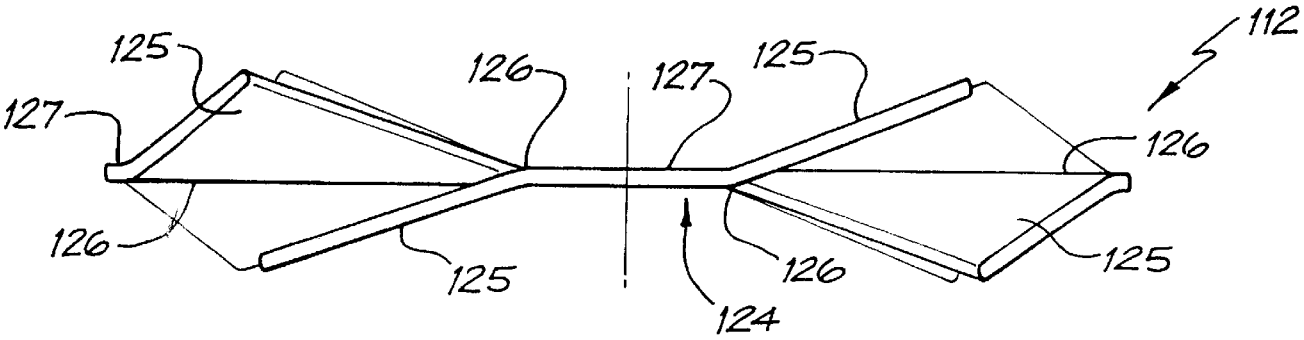
FIG. 4*a* is a side elevation of a blade in direction A of FIG. 2.
Figure 4B:
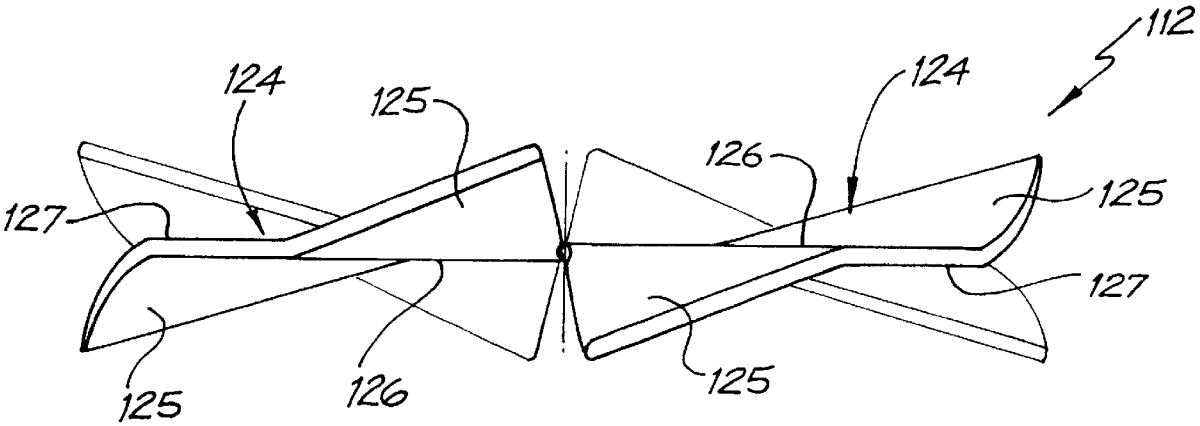
FIG. 4*b* is an elevational view of the blade in direction B of FIG. 2.

It has been found by experiment that the geometric dimensions of the discs 112 are most preferably composed of alternatively flat (disposed in the plane of the rotation of the discs) and shaped blades (disposed at an angle to the plane of the rotation of the discs) where the flat configuration occupy approximately 50% of the total disc area (FIG. 3).

The general geometry of the discs 112 would therefore preferably have a surface area in the plane of the rotation of the discs ranging from 40 to 70% of the total with an optimum area of approximately 50%. The corresponding shaped area of discs 112 would be 60 to 30% with an optimum of 50%. The discs 112 are preferably shaped to provide deformations in the form of deformed plates which create high velocity "flutes" to mix finely divided particles in liquid solutions. The blade shapes are generally triangular to create the greatest fluid velocity at the blade edge, this being located on the perimeter of the discs 112. FIG. 3 illustrates the geometry of discs 112 which are divided into four segments 124 each containing a raised and depressed triangular areas referred to as blades 125 formed about the fold lines 126 on either side of a flat rectangular area 127. The rectangular areas 127 extend along the diameter of the discs as seen in FIG. 3. The slopes of the triangular blade areas 125 relative to the flat rectangular areas 127 range from Tan $\theta$=0.1 to Tan $\theta$=1.0, the optimum slope being between Tan $\theta$=0.3 and 0.4.

Figure 5:
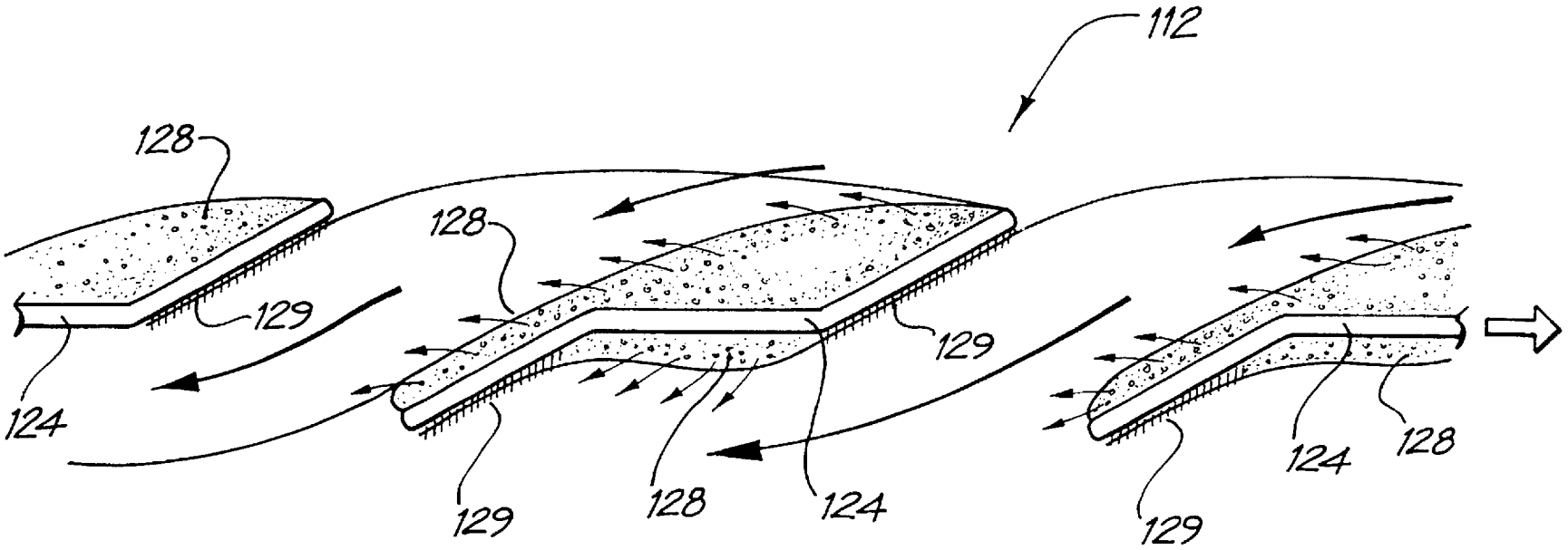
FIG. 5 is a schematic illustration showing the action of the blades of FIGS. 3 and 4 in the apparatus of FIG. 2.

FIG. 5 illustrates the areas of low pressure 128 in which gas air bubbles can form and the high pressure zones 129 which compress the bubbles of gas causing them to implode with great force when there is sufficient peripheral velocity to create the imploding pressures.

The high pressure local shock wave that is produced may exert a pressure of several thousands of atmospheres against the surrounding materials. The cavitation principle is frequently encountered in propellers, dams and spill-ways and in hydraulic pumps and motors. Cavitation is avoided in all design principles. The present invention relates to the harnessing of these forces to act on the slurry grout materials which lie between the imploding bubbles and the disc plates.

The discs 112 themselves may be subjected to metal cavitation but this can be controlled by the density of the slurry grouts and the speed of the discs to provide the necessary disintegration of particle size. FIG. 5 shows the outline of the shaped edge plates which form the discs 112, the disc 112 is rotating in the diagram from left to right and the fluid whether this be water, grout or other forms of fine particle material is moving in the diagram from right to left.

As the fluids pass over high points on the disc 112, low pressure zones 128 are created and bubbles are released across to the high pressure zone 129 of the next profile. If desired the areas of the disc 112 adjacent to the high pressure zones 29 may be coated with a hard wearing surface to reduce cavitation wear. The cavitation bubbles are effectively compressed between the high velocity of the flow of materials and the shaped edge plates of the disc 112.

Depending on the speed of the disc 112, the amount of the cavitation forces can be controlled, to disperse agglomerations of large particles, and at the same time separating and dispersing the extremely small particles of very fine materials.

By increasing the peripheral velocity various mixing modes are created:

a) A speed of approximately 20 meters per second induces progressively b) a speed of up to approximately 20 meters per second gives improved mixing for all types of types of finer materials.

c) when the speed is increased from approximately 20 meters per second to approximately 30 meters per second and beyond various forms of cavitation are created.

d) when speeds are increased from 25 meters per second to 60 or more, controllable cavitation exists and the shock waves created by the implosion forces of small vapor pressure bubbles create extremely large high frequency vibrations and shock waves which can be used to disperse fine particles and or break up agglomerate materials.

In operation it would be expected that the speed of the motor will be varied during the mixing process so that initial mixing is done at a speed below that at which cavitation will occur and the speed raised above that needed to induce cavitation for a time just sufficient to bring about complete mixing of the components of the grout or other slurry being formed. This will reduce wear on the discs 112 due to cavitation to the minimum.

The process according to the invention of mixing finely divided materials offer substantial greater efficiencies in the mixing and processing of fine particles, particularly in cementitious materials.

Figure 6:
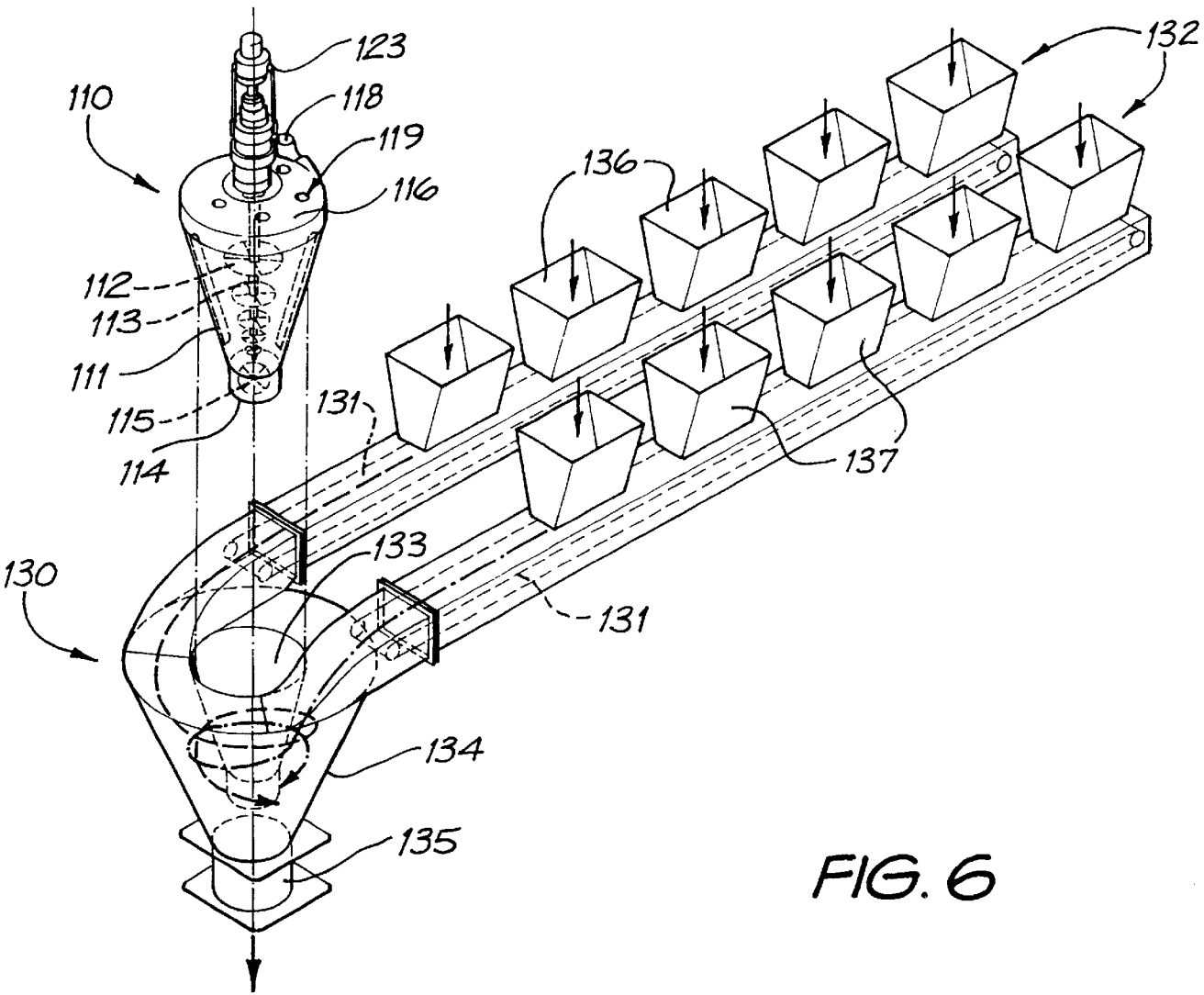
FIG. 6 is a partly exploded perspective view of a concrete producing apparatus according to an aspect of the present invention incorporating the grout mixing apparatus of FIG. 2.
Figure 7:
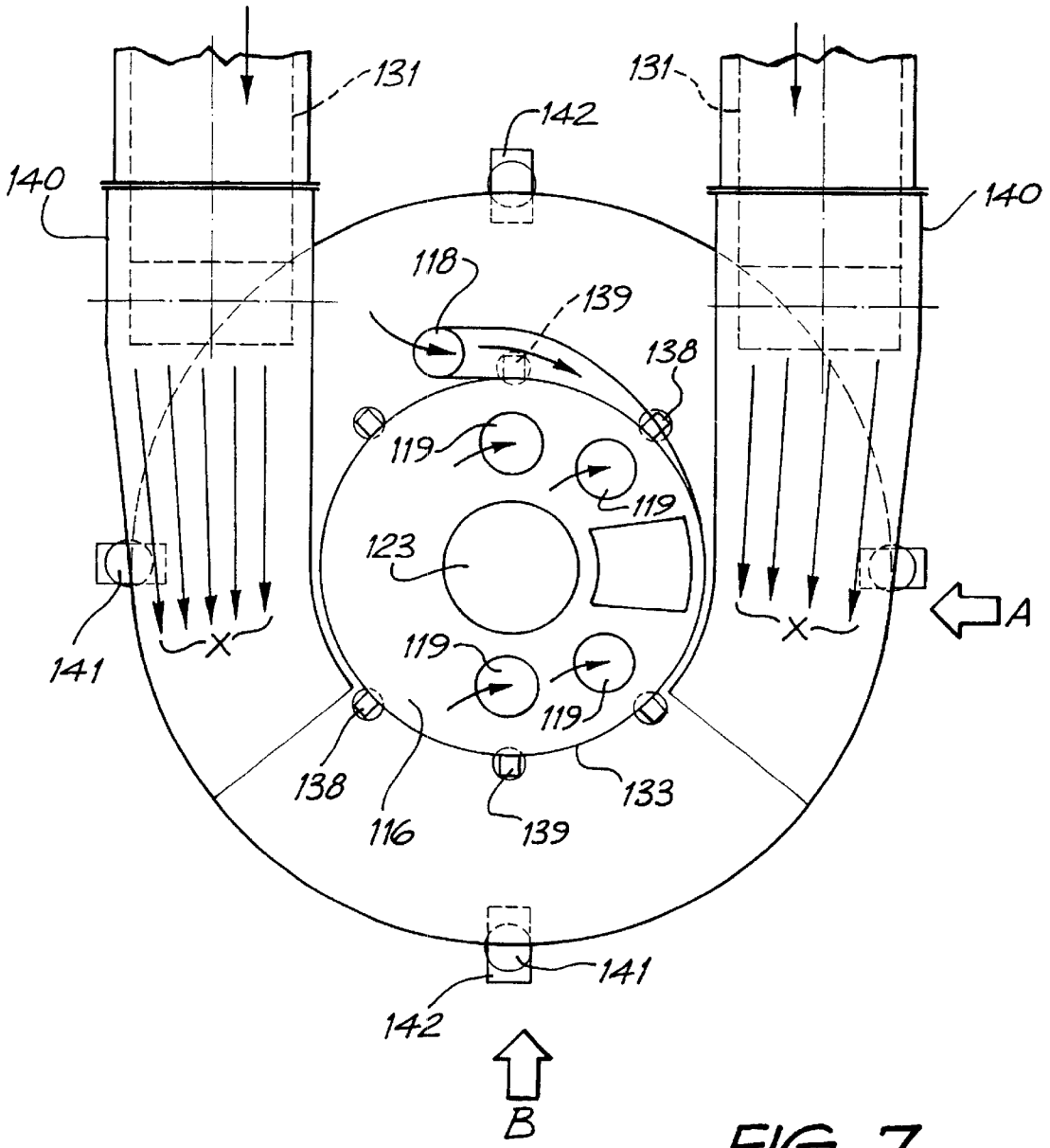
FIG. 7 is a plan view of the cyclonic mixer for aggregate forming part of the apparatus of FIG. 6.
Figure 8:
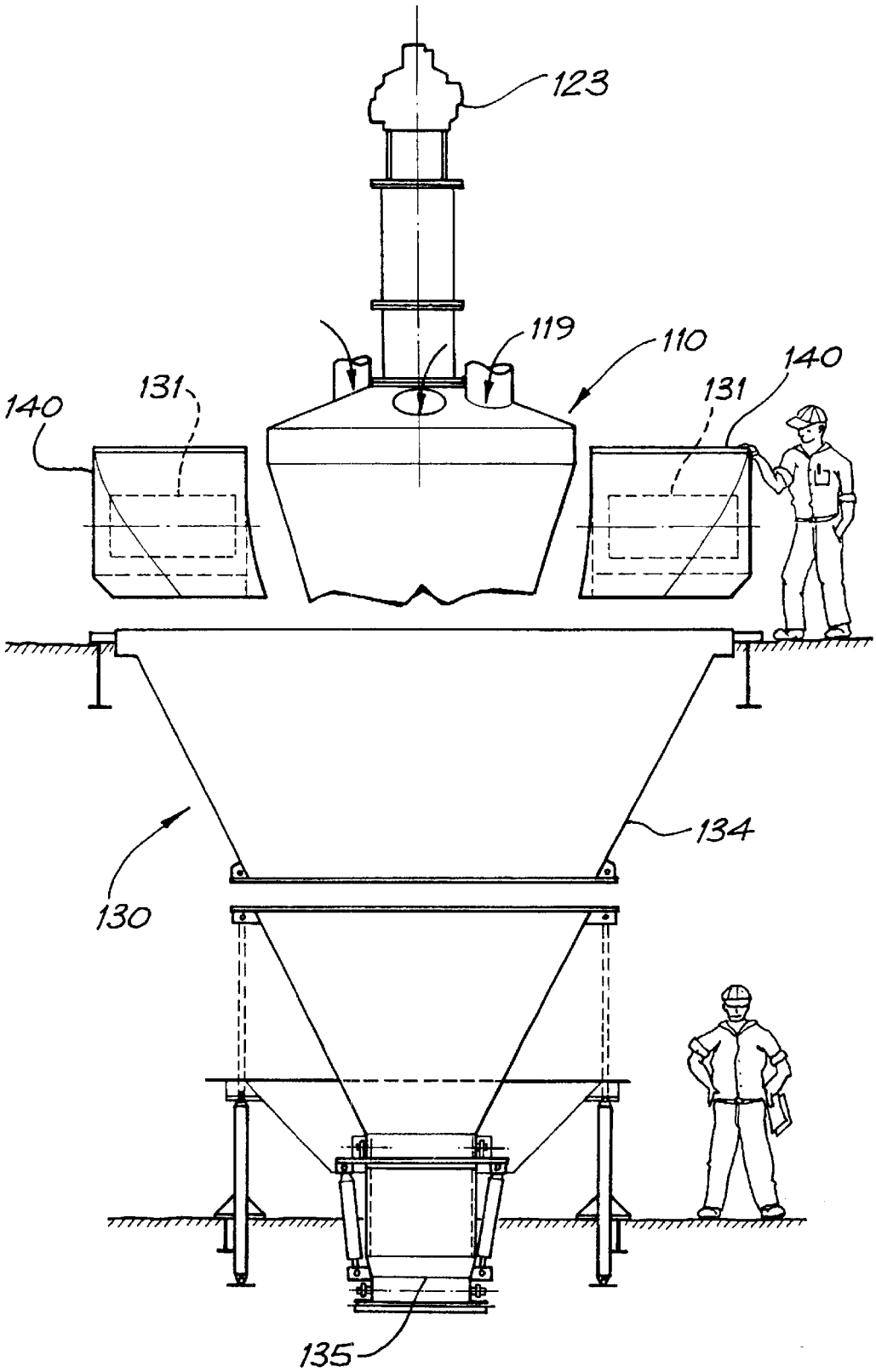
FIG. 8 is a side elevational view of the cyclonic mixer for aggregate of FIG. 7 seen in the direction of arrow B of that Figure.
Figure 9:
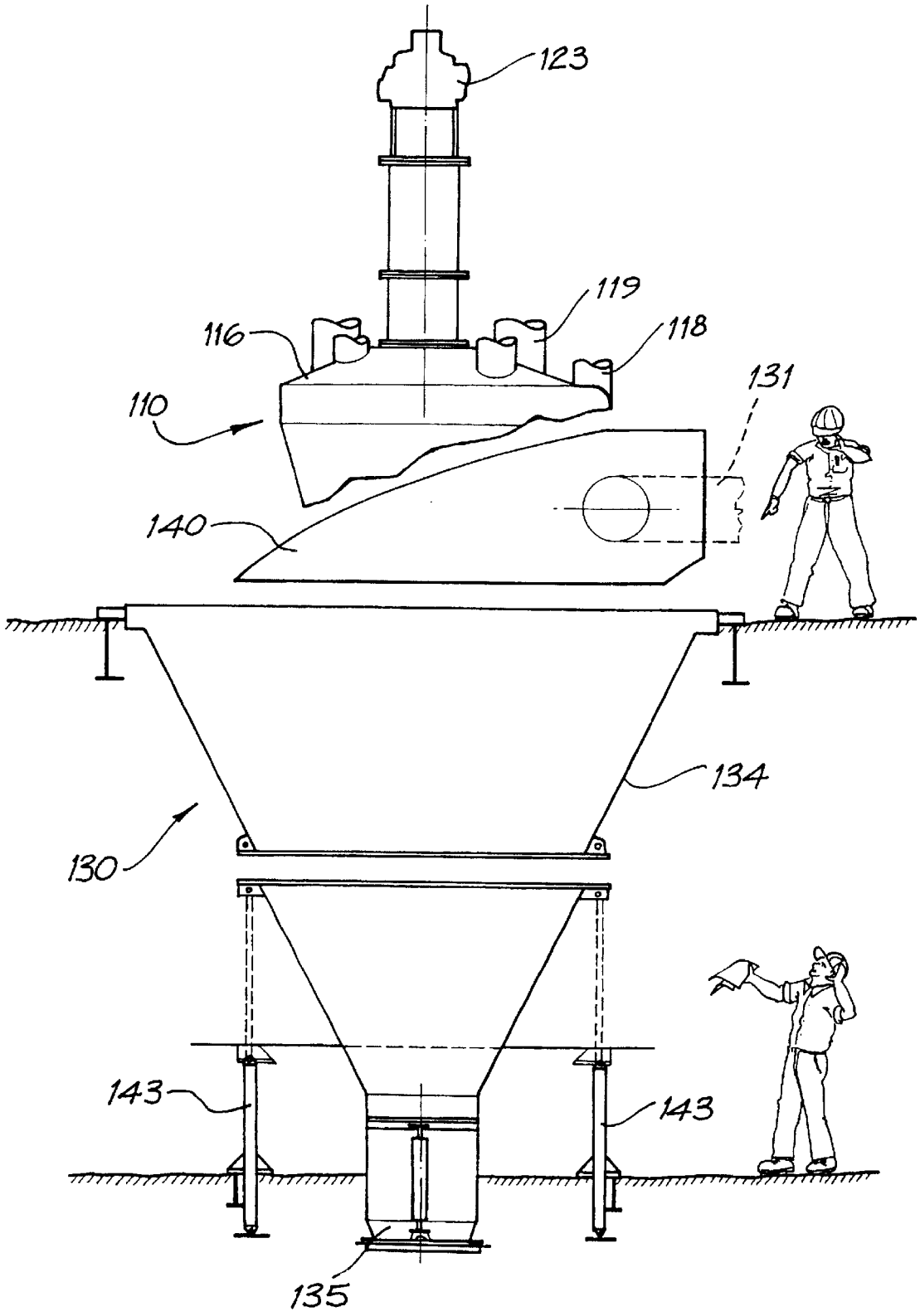
FIG. 9 is a side elevational view of the cyclonic mixer for aggregate of FIG. 7 seen in the direction of arrow A of that Figure.

The second inventive element of the concrete forming machine according to the present invention is the cyclonic aggregate blender 130 into which aggregates are discharged at varying velocities from the conveyors 131 of aggregate weighing system 132 (FIG. 6). By varying the velocities of the conveyors 131, cyclonic mixing of the aggregates is achieved, avoiding segregation of materials. The cyclonic aggregate blender has an inner concentric cone 133, into which the grout mixing machine 110 is adapted to be mounted, and an outer concentric cone 134. A hood 140 is provided above each of the conveyors 131 to guide aggregate from the conveyors 131 into the outer cone 134 in the direction shown by arrows X (FIG. 7). A valve 135 is provided at the lower end of the outer cone 134. The slope of the sides of the cones preferably lie with the range 50° to 75° to the horizontal, with angles of between 60° to 66° being optimum for the present materials. The aggregate supply conveyers 131 are located systematically on either side of the blender 130 (for convenience in this design the conveyers are shown parallel but may be located at any symmetrical angle). The grout mixing machine 110 is supported on 4 compressive load cells 138 and two-anti rotation buffers 139. The aggregate cyclone mixer 130 is also supported by 4 compressive load cells 141 and 4 anti rotation and vibration buffers 142. The outer cone 134 is divided horizontally with the lower half lowerable by hydraulic rains 143 for maintenance.

The third inventive element of the concrete producing apparatus is the aggregate weighing system 132. The system 132 includes aggregate weighing batch bins 136 on one side and 137 on the other side of the system 132 and discharge systematically onto the conveyers 131. In this case five aggregate batch bins 136 have been illustrated supplying each conveyer. The minimum number of bins 136 is one to supply each conveyer 131 while the optimum is one bin 136 for each size of aggregate material being supplied.

Figure 10:
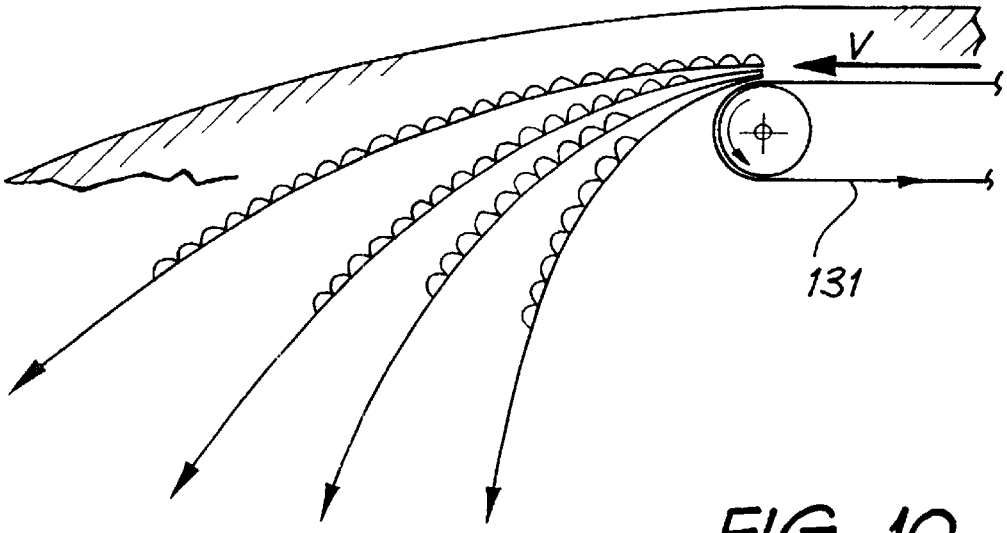
FIG. 10 is a diagrammatic representation showing possible paths of a piece of aggregate leaving the end of one of the conveyors forming part of the apparatus of FIG. 6, at different conveyor speeds.
Figure 11:
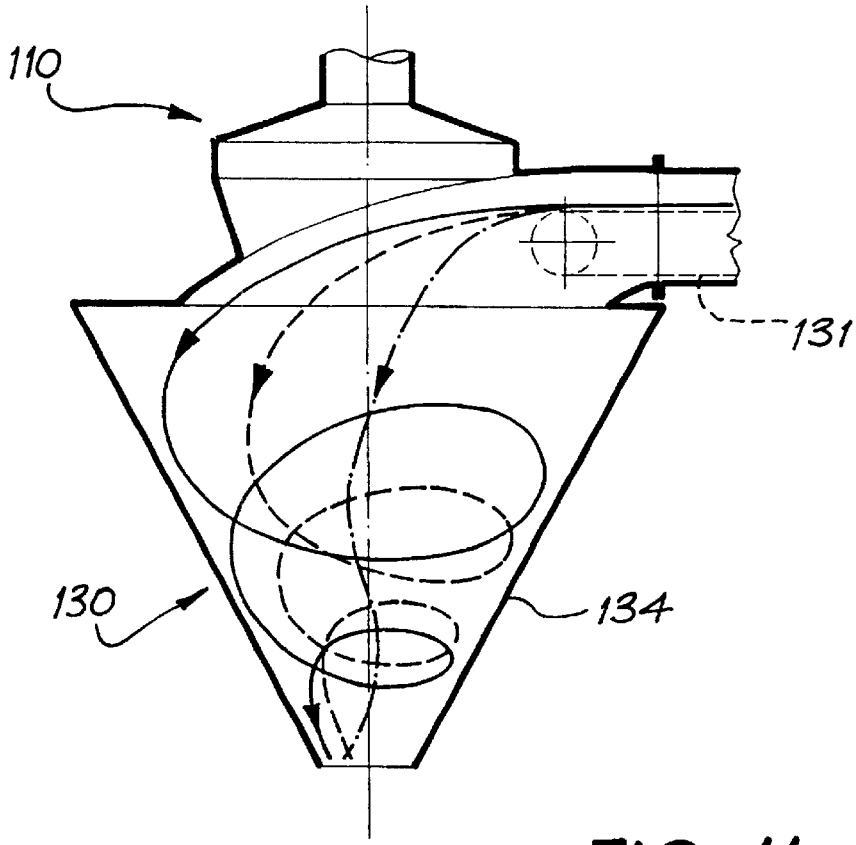
FIG. 11 is a diagrammatic representation of the possible paths taken by a piece of aggregate within the cyclonic mixer for aggregate of FIG. 7.

Each bin 136 is electronically controlled to release the aggregates in a prescribed time and sequence. Conveyers 131 are variable speed ranging from 2 meter/sec to 10 meter/sec and are designed to project the material on different profiles into the cyclone cones (see profile of the aggregate FIGS. 10 and 11). In this manner any desired combination of mixing and blending the materials can be programmed. The angle of the conical blender walls and the projected speed of profiles is such as to avoid angles from 40° to 50° reducing wear on the inside of the blender walls.

Aggregates are loaded into each of a number of weigh bins 136, typically arranged in pairs one set for each size of aggregate, to be used in the plant. The invention relates, in part, to the operation of these variable speed conveyors 131 to place materials into the cyclonic aggregate blender 130 at different velocities to cyclonically mix the aggregates and avoid segregation of materials.

Operation

Fine cementitious materials, water and additives are loaded into the grout mixing machine 110 through openings 119 as illustrated in FIG. 6 and mixed to a liquid grout.

Cement, the heaviest material being added, is symmetrically loaded through two large openings 119 and silica fume and pulverised fuel ash (Pfa) being relatively small quantities are loaded through smaller off-centre openings 119. The symmetry of cement loading is desirable to avoid large out of balance forces on the turbine due to the weight of cement being discharged at over 300 kg/sec. The water entry is via the cyclonic profile through inlet duct 118 and has an entry velocity ranging from 1 meter/sec to 20 meter/sec. When cementitious materials are added to the grout mixing machine 110 the displacement of air is discharged through the water inlet 118 acting as the dust control discharge system.

At the same time, although not specifically related, the aggregates are blended in the cyclonic aggregate blender by varying the speeds of the conveyers 131 according to the size of each material on the conveyer 131 to 'throw' the materials around the cyclone layers thus avoiding segregation or the grouping of one particular size material.

When completed the discharge valve 115 of the grout mixing machine 110 acting as a high speed turbine pump forces the cementitious grout and the aggregates through the discharge gate 135 into a concrete mixing truck (not shown) suitably positioned to receive the materials. The thrust of the grout turbine, forces the grout mixture through the aggregates into the truck mixing bowl completely mixing the ingredients in a very short space of time, for example 8–10 seconds.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A method of forming a slurry of particles of fine materials in a liquid, wherein the mixing and dividing of agglomerations of the particles of fine materials is carried out by subjecting a slurry of the agglomerations of particles to the action of one or more rotating discs, said one or more discs including four substantially equal quadrants wherein each quadrant includes a rectangular zone lying in the plane of rotation of the one or more discs, a first triangular-shaped blade continuous with the rectangular zone but lying at an angle to and above that plane and a second triangular-shaped blade continuous on an opposing side of the rectangular zone but lying at an angle to and below said plane, the rectangular zones extending along the diameter of the one or more discs the one or more discs being arranged to create within the slurry alternating areas of high and low pressures, bubbles being formed in the low pressure zones and being compressed in the high pressure zones to implode with great force thereby breaking up the agglomerations of particles and at the same time separating and dispersing the individual particles of fine materials.

2. A method as claimed in claim 1 in which the slurry includes a cementitious material, chemical additives and water.

3. An apparatus for forming a slurry of particles of fine material in a liquid, the apparatus including a housing adapted to receive and hold a slurry of particles of fine materials in a liquid which slurry contains agglomerations of the particles, and located within the housing one or more rotatable discs, said one or more discs including four substantially equal quadrants wherein each quadrant includes a rectangular zone lying in the plane of rotation of the one or more discs, a first triangular-shaped blade continuous with the rectangular zone but lying at an angle to and above that plane and a second triangular-shaped blade continuous on an opposing side of the rectangular zone but lying at an angle to and below said plane, the rectangular zones extending along the diameter of the one or more discs, the one or more discs being arranged to create within the slurry alternating areas of high and low pressure such that bubbles are formed in the low pressure zones and are compressed in the high pressure zones to implode with great force thereby breaking up the agglomerations of particles and at the same time separating and dispersing the individual particles of fine materials.

4. An apparatus as claimed in claim 3 in which the rectangular zones lying in the plane of rotation of the disc comprise from 40% to 70% of the surface area of the disc.

5. An apparatus as claimed in claim 4 which the zone or zones lying in the plane of rotation of the disc comprise substantially 50% of the surface area of the disc.

6. An apparatus as claimed in claim 3 in which the blades lie in a plane or planes at an angle $\theta$ to the plane of rotation of the disk which angle is such that $\tan \theta = 0.1$ to 1.0.

7. An apparatus as claimed in claim 3 in which the or each disc is substantially circular in shape.

* * * * *

UNITED STATES PATENT AND TRADEMARK OFFICE

CERTIFICATE OF CORRECTION

PATENT NO. : 6,481,883 B1
DATED : November 19, 2002
INVENTOR(S) : Ellen

It is certified that error appears in the above-identified patent and that said Letters Patent is hereby corrected as shown below:

Column 2,
Line 21, replace “exact weighed materials” with -- ‘exact weighed materials’ --.

Column 6,
Line 3, after “to the shaft 113.” insert -- A plurality of mixing discs 112 are mounted concentrically and in spaced apart array along the length of the shaft 113. --.
Lines 7-8, after “discs)” insert -- blades --.
Lines 7-8, after “shaped” delete “blades”
Line 55, replace “29” with -- 129 --.
Line 66, replace “20” with -- 10 --.
Line 67, after “progressively” insert -- higher rates of mixing of normal large particle sizes similar to that of normal Portland cement. --.

Column 7,
Line 5, replace “increased” with -- created --.
Line 49, replace “rains” with -- rams --.

Signed and Sealed this

Fifteenth Day of July, 2003

JAMES E. ROGAN
*Director of the United States Patent and Trademark Office*